US007770294B2

(12) United States Patent
Bruno et al.

(10) Patent No.: US 7,770,294 B2
(45) Date of Patent: Aug. 10, 2010

(54) RAZOR WITH BLADE UNIT BIASING MEMBER

(75) Inventors: Michael Hal Bruno, Burlington, MA (US); William Owen Jolley, Spencer, MA (US); John Prudden, Jr., Essex, MA (US)

(73) Assignee: The Gillette Company, Boston, MA (US)

( * ) Notice: Subject to any disclaimer, the term of this patent is extended or adjusted under 35 U.S.C. 154(b) by 389 days.

(21) Appl. No.: 11/897,313

(22) Filed: Aug. 30, 2007

(65) Prior Publication Data

US 2009/0056140 A1 Mar. 5, 2009

(51) Int. Cl.
*B26B 21/00* (2006.01)
*B26B 21/52* (2006.01)

(52) U.S. Cl. ..... 30/50; 30/51; 30/526; 30/527

(58) Field of Classification Search ..... 30/47, 30/50, 51, 57, 526, 527, 531, 532; D28/47
See application file for complete search history.

(56) References Cited

U.S. PATENT DOCUMENTS 4,026,016 A * 5/1977 Nissen ..... 30/47
4,266,340 A * 5/1981 Bowman ..... 30/532
4,488,357 A * 12/1984 Jacobson ..... 30/57
4,492,025 A * 1/1985 Jacobson ..... 30/530
4,797,998 A * 1/1989 Motta ..... 30/530
4,985,995 A * 1/1991 Coffin ..... 30/84
5,016,352 A * 5/1991 Metcalf ..... 30/532
5,251,376 A * 10/1993 Althaus et al. ..... 30/50
5,253,420 A * 10/1993 Althaus et al. ..... 30/50
5,784,790 A * 7/1998 Carson et al. ..... 30/532
5,787,586 A 8/1998 Apprille, Jr. et al.
5,813,293 A * 9/1998 Apprille et al. ..... 30/50
5,822,869 A * 10/1998 Metcalf et al. ..... 30/526
5,855,071 A * 1/1999 Apprille et al. ..... 30/532
5,918,369 A * 7/1999 Apprille et al. ..... 30/47
5,956,851 A * 9/1999 Apprille et al. ..... 30/47
6,026,577 A * 2/2000 Ferraro ..... 30/526
6,029,354 A * 2/2000 Apprille et al. ..... 30/47
6,173,498 B1 * 1/2001 Warrick et al. ..... 30/50
6,223,442 B1 * 5/2001 Pina ..... 30/527
6,557,265 B2 * 5/2003 Coffin ..... 30/532
6,584,690 B2 7/2003 Orloff et al.
6,877,227 B2 * 4/2005 Santhagens Van Eibergen et al. ..... 30/50

(Continued)

FOREIGN PATENT DOCUMENTS

WO WO 2004/103653 12/2004

(Continued)

*Primary Examiner*—Jason Daniel Prone
(74) *Attorney, Agent, or Firm*—John M. Lipchitz; Kevin C. Johnson; Steven W. Miller

(57) ABSTRACT

A razor including a replaceable shaving cartridge. The replaceable shaving cartridge includes a pivotal frame, a blade unit moveably secured to the pivotal frame and an interconnect member. The blade unit includes one or more blades and has a camming surface. The interconnect member has a pivotal support structure that pivotally supports the pivotal frame for pivoting about a pivot axis. A biasing member that has a cam follower surface extends from the interconnect member to act on the camming surface to bias the blade unit. A handle is releasably secured to the interconnect member.

5 Claims, 13 Drawing Sheets

U.S. PATENT DOCUMENTS

| | | | | |
|---|---|---|---|---|
| 6,996,908 | B2 | 2/2006 | Orloff et al. | |
| 7,024,776 | B2 * | 4/2006 | Wain | 30/50 |
| D524,986 | S * | 7/2006 | Prudden, Jr. | |
| 7,103,976 | B2 * | 9/2006 | Pennella | 30/526 |
| 7,127,817 | B2 | 10/2006 | Orloff et al. | |
| 7,137,205 | B2 * | 11/2006 | Royle | 30/527 |
| 7,168,173 | B2 * | 1/2007 | Worrick, III | 30/527 |
| 7,219,430 | B2 * | 5/2007 | Fandrey et al. | 30/527 |
| 7,272,991 | B2 * | 9/2007 | Aviza et al. | 30/50 |
| 7,370,419 | B2 * | 5/2008 | Coffin et al. | 30/50 |
| 7,500,313 | B2 * | 3/2009 | Fandrey et al. | 30/527 |
| 7,526,869 | B2 * | 5/2009 | Blatter et al. | 30/532 |
| 7,574,809 | B2 * | 8/2009 | Follo et al. | 30/527 |
| 7,607,230 | B2 * | 10/2009 | Aviza et al. | 30/50 |
| 7,621,203 | B2 * | 11/2009 | Aviza | 30/51 |
| 7,658,009 | B2 * | 2/2010 | Bunnell et al. | 30/527 |
| 2001/0013174 | A1 * | 8/2001 | Zucker | 30/50 |
| 2005/0188539 | A1 * | 9/2005 | Prudden et al. | 30/41 |
| 2008/0034590 | A1 * | 2/2008 | Prudden et al. | 30/34.2 |
| 2008/0256803 | A1 * | 10/2008 | Tucker et al. | 30/50 |
| 2009/0288299 | A1 * | 11/2009 | Denkert et al. | 30/50 |
| 2009/0293281 | A1 * | 12/2009 | Bruno | 30/50 |
| 2010/0043242 | A1 * | 2/2010 | Stevens | 30/527 |

FOREIGN PATENT DOCUMENTS

| | | |
|---|---|---|
| WO | WO 2005/065896 | 7/2005 |
| WO | WO 2005/090019 | 9/2005 |
| WO | WO 2007/008360 | 1/2007 |
| WO | WO 2007/008931 | 1/2007 |

* cited by examiner

RAZOR WITH BLADE UNIT BIASING MEMBER

FIELD OF THE INVENTION

The present invention relates to shaving razors and more particularly to shaving razors including a pivotal frame and a blade unit and a biasing member that biases the blade unit.

BACKGROUND OF THE INVENTION

A shaving razor in its basic form includes a handle and a cartridge in which one or more blades are mounted. In a disposable razor when the blades become dull from use, the entire razor is discarded and replaced with a new razor. In a shaving system when the blades become dull from use, the cartridge is discarded and replaced on the handle with a new cartridge.

In some shaving razors the blades are resiliently mounted in the shaving cartridge and deflect under the force of skin contact during shaving. In some shaving razors the connection of the cartridge to the handle provides a pivotal mounting on the cartridge with respect to the handle so that the cartridge angle adjusts to follow the contours of the skin surface being shaved. In such razors the cartridge can be biased toward an at rest position by the action of a spring-biased plunger and a cam follower carried on the handle against a cam surface found on the cartridge.

With respect to cartridges comprised of two components such as a pivotal frame and a blade unit there is a need to provide a biasing member that acts on the blade unit to bias the blade unit into the preferred shaving position.

SUMMARY OF THE INVENTION

In accordance with the present invention a razor is provided. The razor includes comprises a shaving cartridge comprising a pivotal frame, a blade unit moveably secured to the pivotal frame and an interconnect member. The The biasing member comprises a spring biased plunger or a cantilever spring. The razor may include one, two or more biasing members.

The handle comprises a cartridge support structure shaped to mate with a recess in the interconnect member and the biasing member extends from the cartridge support structure.

The pivotal frame has an upper surface and a lower surface and the cam follower biases the blade unit toward the upper surface of the pivotal frame.

The camming surface permits the pivotal frame to pivot in only one direction from an at rest position.

The razor may be disposable where the entire razor is discarded when the blades become dull from use or a system where the cartridge is discarded and replaced when the blades become dull from use and is replaced on the handle with a new cartridge.

The interconnect member comprises a base structure. The cartridge support structure of the handle is shaped to mate with a recess in the base structure of the interconnect member.

The blade unit is moveably secured to the pivotal frame between a first position and a second position and the biasing member that has a cam follower surface and extends from the interconnect member and through the cam follower opening to act on the camming surface to bias the blade unit toward the second position.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
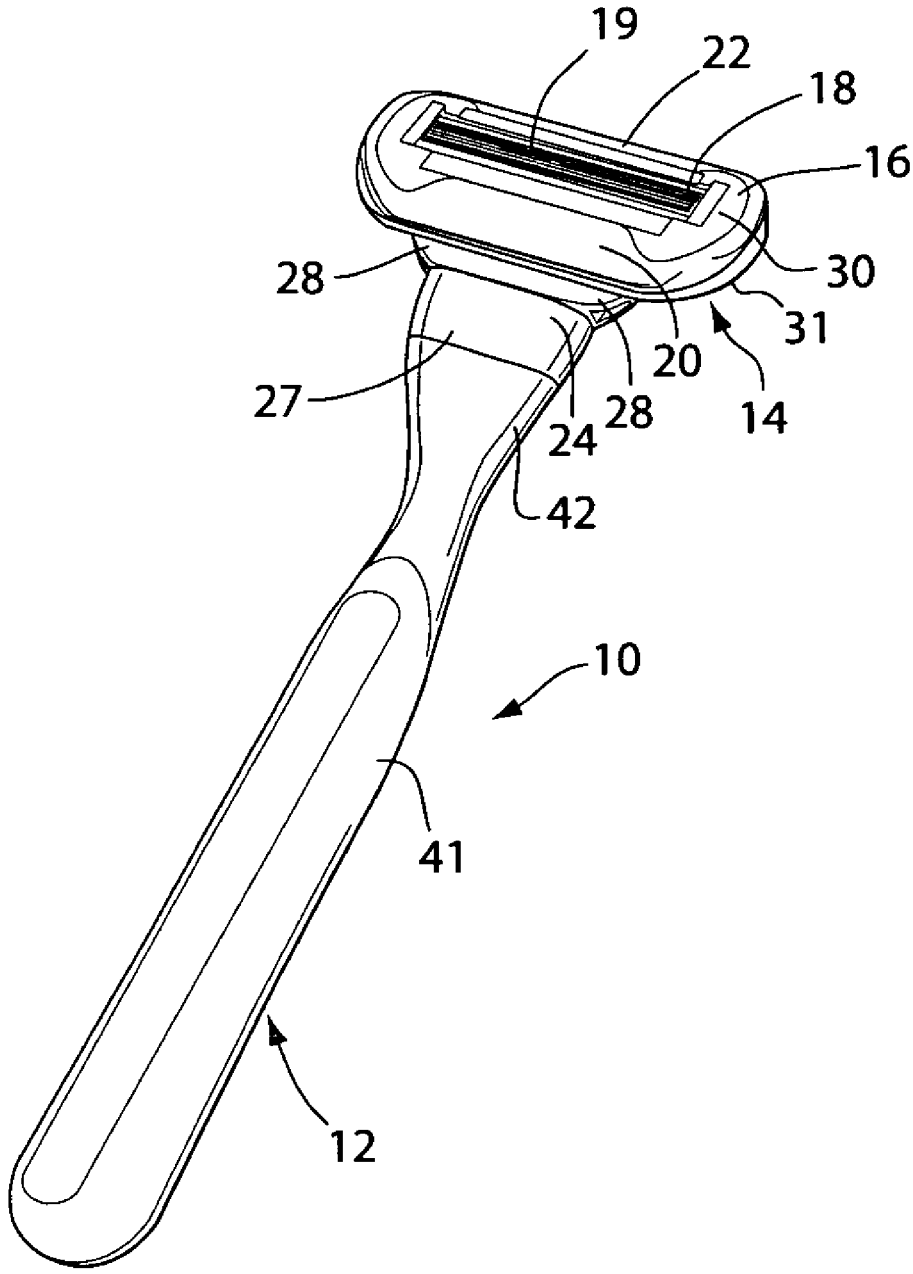
FIG. 1 is a perspective view of a shaving razor of the present invention.
Figure 2:
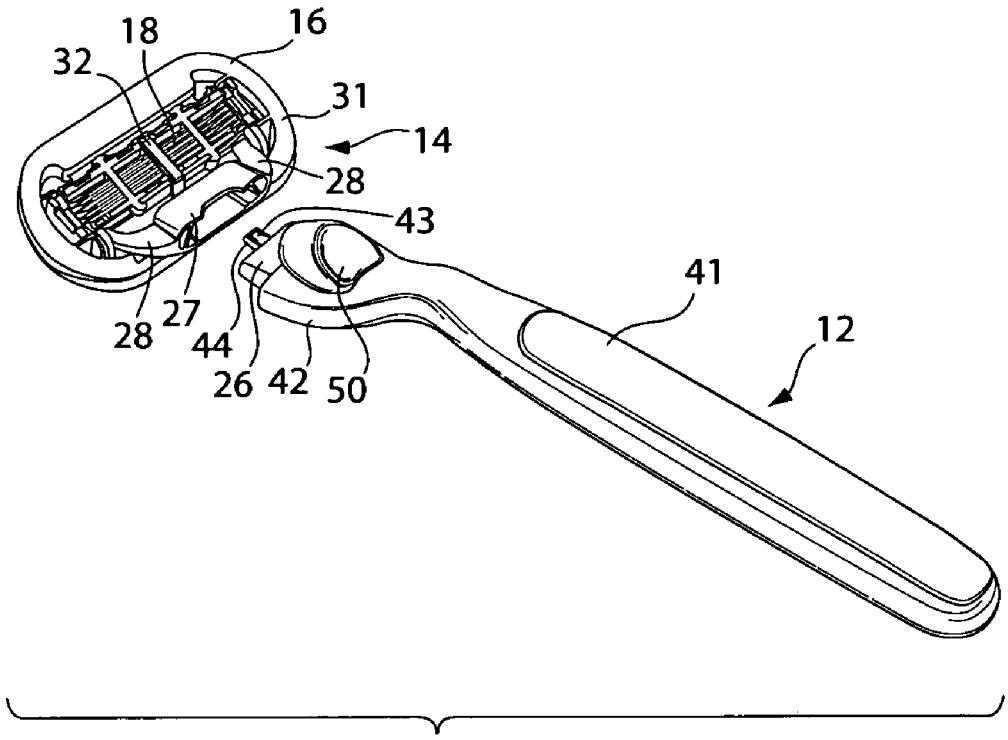
FIG. 2 is a perspective view a handle and a replaceable cartridge of the FIG. 1 razor separated from each other.

Referring to FIGS. 1 and 2, shaving razor 10 includes handle 12 and replaceable shaving cartridge 14. As shown in FIG. 2, cartridge 14 is releasably secured to handle 12 such that it is removable from handle 12. Cartridge 14 includes pivotal frame 16 and blade unit 18 moveably secured to pivotal frame 16. Cartridge 14 also includes interconnect member 24 on which pivotal frame 16 is pivotally mounted. Interconnect member 24 includes central base 27, which removably and fixedly attaches to extension 26 of handle 12 and two arms 28 extending from central base 27 that pivotally support pivotal frame 16 at its two sides.

Pivotal frame 16 includes an upper surface 30 and a lower surface 31. Upper surface 30 of pivotal frame 16 is the skin contacting surface or shaving surface of pivotal frame 16.

Upper surface 30 of pivotal frame 16 includes a guard 20 and a cap 22. Blade unit 18 includes one more blades 19. In the embodiment shown in FIGS. 1 and 2, blade unit 18 includes three blades 19. Blade unit 18 also includes camming surface 32.

Cartridge support structure 42 of handle 12 extends from the end of elongated gripping portion 41. Cartridge support structure 42 includes shaped extension 26 and the components that provide a biasing member 43 which in this embodiment is a spring-biased plunger 44 for biasing the blade unit 18 relative to pivotal frame 16 and pivotal frame 16 relative to interconnect member 24. It also includes components that provide for ejection of cartridge 14 from handle 12.

Figure 3:
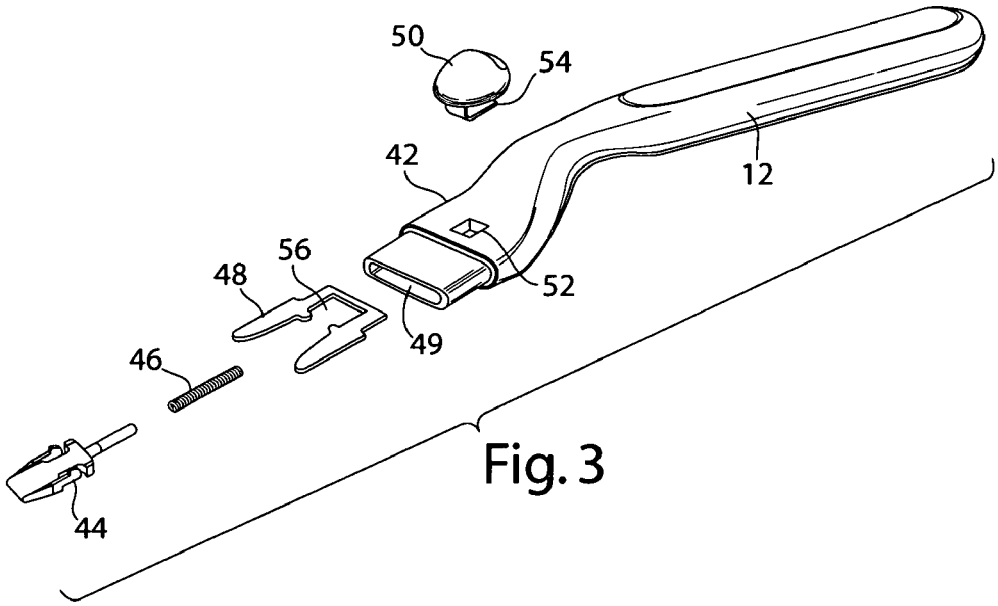
FIG. 3 is an exploded view of the components of the handle of FIG. 2.

Referring now to FIG. 3, there is shown an exploded view of the components of handle 12. Spring-biased plunger 44, spring 46 and U-shaped ejector 48 are received within recess 49 of cartridge support structure 42. Ejector button 50 is received in opening 52 on the top surface of support structure 42 and has bottom extensions 54 that are received within rectangular region 56 at the back narrow portion of ejector 48.

FIGS. 4-11 show the details of spring-biased plunger 44, ejector 48, button 50 and cartridge support structure 42. Recess 49 within cartridge support structure 42 has wide front portion 76 for receiving arms 78 of ejector 48 and a narrower portion 80 for receiving narrower portion 82 of ejector 48. Rectangular region 56 at narrow portion 82 of ejector 48 is generally aligned with opening 52 at the upper surface of support structure 42, though rectangular region 56 is movable with respect to opening 52 along slide axis 83 as ejector 48 is pushed outward by ejector button 50.

Each extension 54 of ejector button 50 has an outwardly directed groove 84 that slides on a respective track 86 within opening 52 along axis 83. The upper surfaces 85 defining grooves 84 slide on the upper surface 89 of tracks 86, and the lower surfaces 91 defining grooves 84 effect capture on or about the lower surfaces 93 of track 86. Extensions 54 have inclined surfaces 87 that coact with the curved upper corners of tracks 86 to deflect extensions 54 inward as button 50 is inserted into cartridge support structure 42. When grooves 84 on extension 54 align with tracks 86, extensions 54 substantially return to their undeflected position and lock ejector button 50 in place within opening 52. Ejector 48 is placed within recess 49 before button 50 is inserted so that the ends of extensions 54 will be located within rectangular region 56 so as to retain ejector 48 within cartridge support structure 42. Extensions 54 push against surfaces 94 of ejector 48 when ejector button 50 is pushed toward the end of handle 12. After button 50 has been inserted, upper vertical surfaces 96 of extensions 54 sit within the space between upper surfaces 98 of opening 52.

Figure 7:
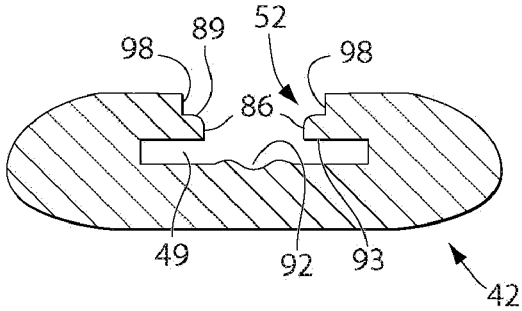
FIG. 7 is a sectional view of the cartridge support structure taken along 7-7 of FIG. 4.

Spring 46 (FIG. 3) extends through the space between extensions 54 and is guided by the curved lower surface of spring guide 90 on button 50. As shown in FIG. 7, the lower surface defining recess 49 also has a curved central portion 92 to receive and guide spring 46.

Figure 5:
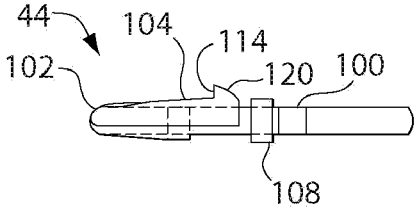
FIG. 5 is an elevation view of a plunger of the handle FIG. 2.
Figure 6:
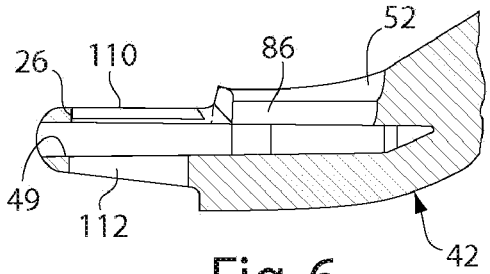
FIG. 6 is a partial sectional view of the cartridge support structure taken along 6-6 of FIG. 4
Figure 10:
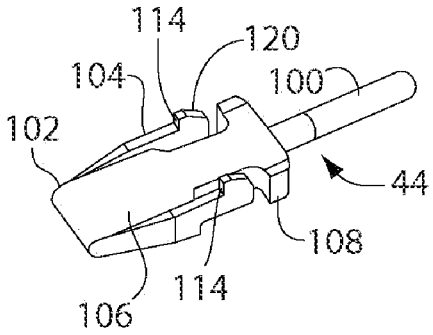
FIG. 10 is a perspective view of the FIG. 5 plunger.
Figure 11:
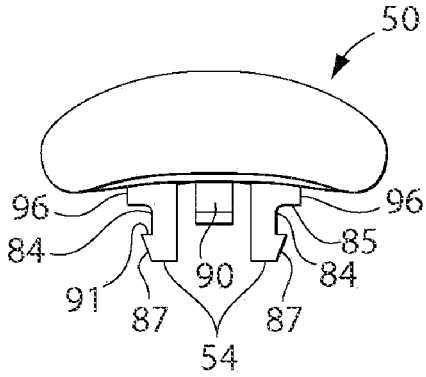
FIG. 11 is an elevation view of an ejector button used in the cartridge support structure of FIG. 5.

As shown in FIGS. 5 and 10, plunger 44 has flat body 106, cylindrical rear extension 100 for receiving spring 46 (FIG. 3), curved front cam follower portion 102 for action on the camming surface 32 of pivotal frame 16 (FIG. 2), side arms 104 and aligned rear guide portions 108. Flat body 106 is positioned within the flat front portion of recess 49. The portions of side arms 104 and aligned rear guide portions 108 above and below body 106 are located within slots 110, 112 located on both sides of asymmetrical extension 26. Side arms 104 have stop surfaces 114 that prevent forward movement of plunger 44 beyond the front of slot 110 and 112. The portions of side arms 104 and guide portions 108 above and below recess 49 within slots 110, 112 act as guides to guide the sliding action of plunger 44 along axis 83.

Side arms 104 have inclined surfaces 120 to cause downward biasing of arms 104 when plunger 44 is inserted into recess 49 until stop surfaces 114 advance past the front ends of slots 110, 112 and stop surfaces 114 snap into position within the respective slot. Because slots 110, 112 are provided on both sides of extensions 26, plunger 44 can be inserted in either position orientation, with the stop surface 114 directed into slot 110 or 112.

Figure 4:
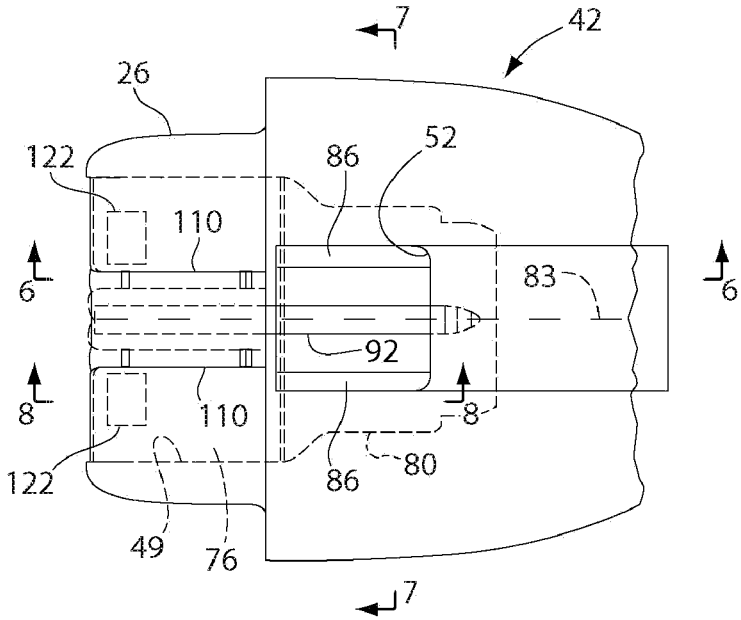
FIG. 4 is a partial plan view showing a cartridge support structure at the end of the handle of FIG. 2.
Figure 8:
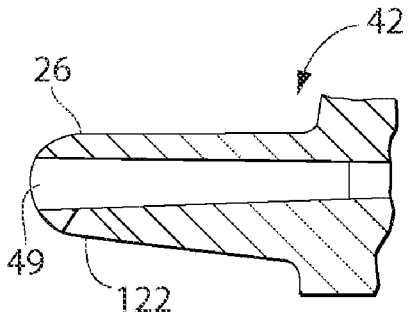
FIG. 8 is a partial sectional view of the cartridge support structure taken along 8-8 of FIG. 4.
Figure 9:
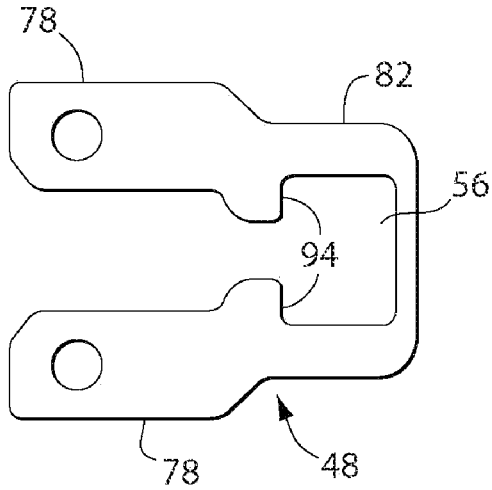
FIG. 9 is a plan view of an ejector used in the FIG. 4 cartridge support structure.

Referring to FIGS. 4 and 8, one surface of extension 26 includes depressions 122 for receiving detents within central base structure 27 of cartridge 14 in order to retain cartridge 14 on extension 26.

In the manufacture of handle 12, elongated hand gripping portion 41 may be a single component or multiple components secured together to form a unitary structure.

In assembling the components of cartridge support structure 42 at the end of handle 12, ejector 48 is first inserted into recess 49. Spring 46 and plunger 44 are then inserted. Inclined surfaces 120 of side arms 104 are biased during insertion toward the middle of the recess and then snap into slot 110 or 112 (depending upon plunger orientation) locking plunger 44, spring 46, and ejector 48 in place in cartridge support structure 42. Spring 46 acts both to bias ejector 48 backward against the surfaces of recess 49 and button extensions 54 and to bias plunger 44 forward, stop surfaces 114 being biased against the forward edges of slot 110 or 112. Button 50 is inserted into opening 52 after ejector 48 has been inserted into position. Inclined surfaces 87 are biased inward by the curved upper portions of rails 86, and ejector button 50 is snapped into place within tracks 86 being located within grooves 84.

Figure 12:
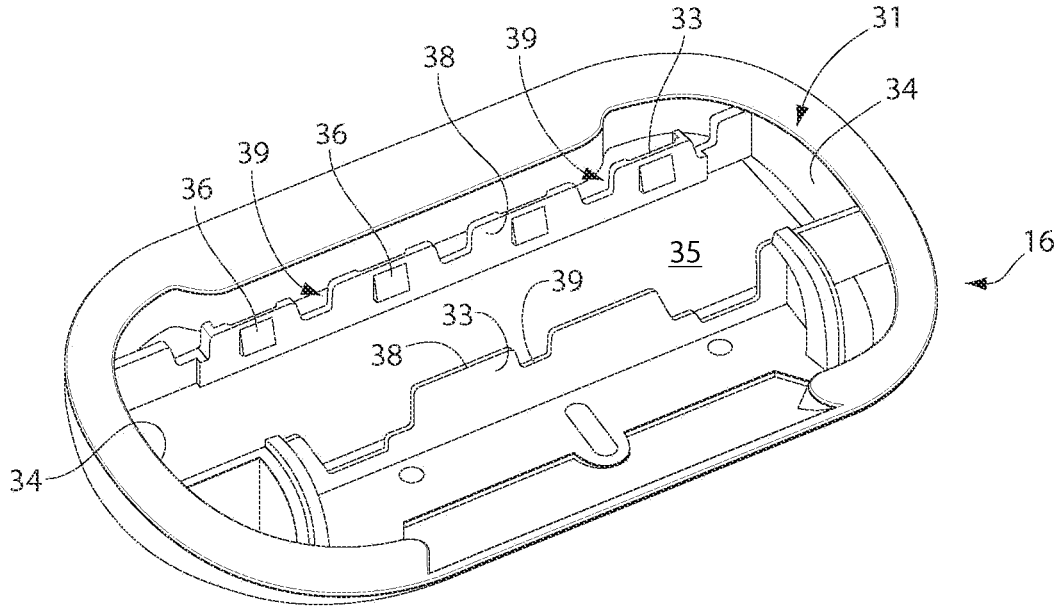
FIG. 12 is a bottom perspective view of the pivotal frame of the replaceable cartridge of FIG. 1.

Referring now to FIG. 12 there is shown the bottom surface 31 of pivotal frame 16. Pivotal frame 16 includes two pair of interior walls 33 and 34 defining opening 35. Interior walls 33 are longer than interior walls 34. Interior walls 33 include a plurality of prongs 36 along each interior face 38. The prongs 36 are only shown on one interior face in FIG. 12. Each wall 33 also includes a plurality of guide grooves 39 along the top of the wall.

Figure 13:
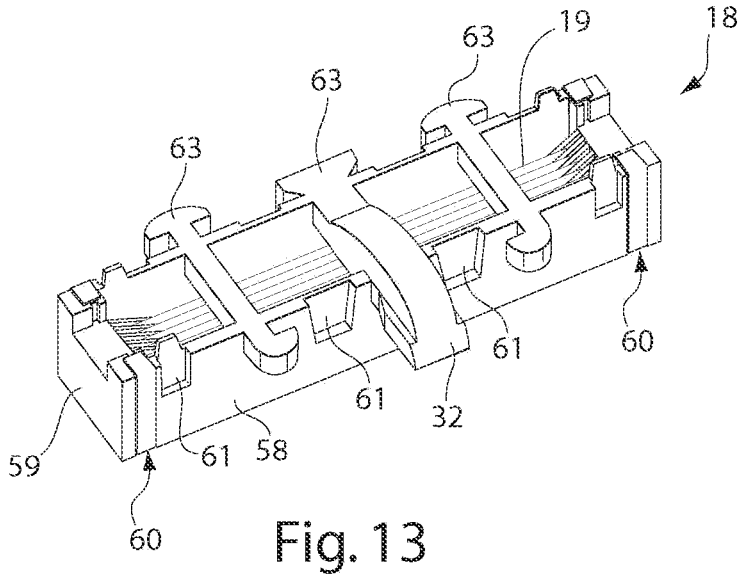
FIG. 13 is a bottom perspective view of the blade unit of the replaceable cartridge of FIG. 1.

Referring now to FIG. 13 there is shown blade unit 18 containing blades 19. Blade unit 18 includes a pair of long walls 58 and a pair of short walls 59. A pair of clips 60 secure blades 19 within blade unit 18. Long walls 58 each contain a plurality of indetents 61. The indents 61 are only shown on one wall 58 in FIG. 13. Blade unit 18 also includes three guide bars 63. Central guide bar 63 includes camming surface 32.

When joining blade unit 18 with pivotal frame 16 a snap fit connection is formed between blade unit 18 and pivotal frame 16. Blade unit 18 is sized and shaped to fit within opening 35 of pivotal frame 16. Guide bars 63 on blade unit 18 rest within grooves 39 of pivotal frame 16. Indents 61 on blade unit 18 engage with prongs 36 of blade unit 18. The engagement of indents 61 with prongs 36 moveably secures pivotal frame 16 to blade unit 18. The term moveably secures is used to describe the condition where the blade unit 18 is secured to the pivotal frame 16 but is capable of relatively small movements within the pivotal frame. The allowance for small movements comes about as there is some tolerance built in to the prong and indent dimensions respectively such that they are not an exact match. That is, the prong dimensions are slightly smaller than the indent dimensions. Such tolerances are necessary for manufacturing purposes.

Referring now to FIG. 2, while the moveable securement only allows the blade unit 18 to move a relatively small distance within the pivotal frame 16, such movement can impact the shaving performance. Cam follower 102 of biasing member 43 pushes against camming surface 32 to bias blade unit 18 into the preferred shaving position, i.e., toward upper surface 30 of pivotal frame 16.

The blade unit 18 moves within pivotal frame 16 between a first position and a second position. In the first position the blade unit 18 is nearest the lower surface 31 of pivotal frame 16. In the second position the blade unit 18 is nearest the upper surface 30 of pivotal frame 16.

Figure 14:
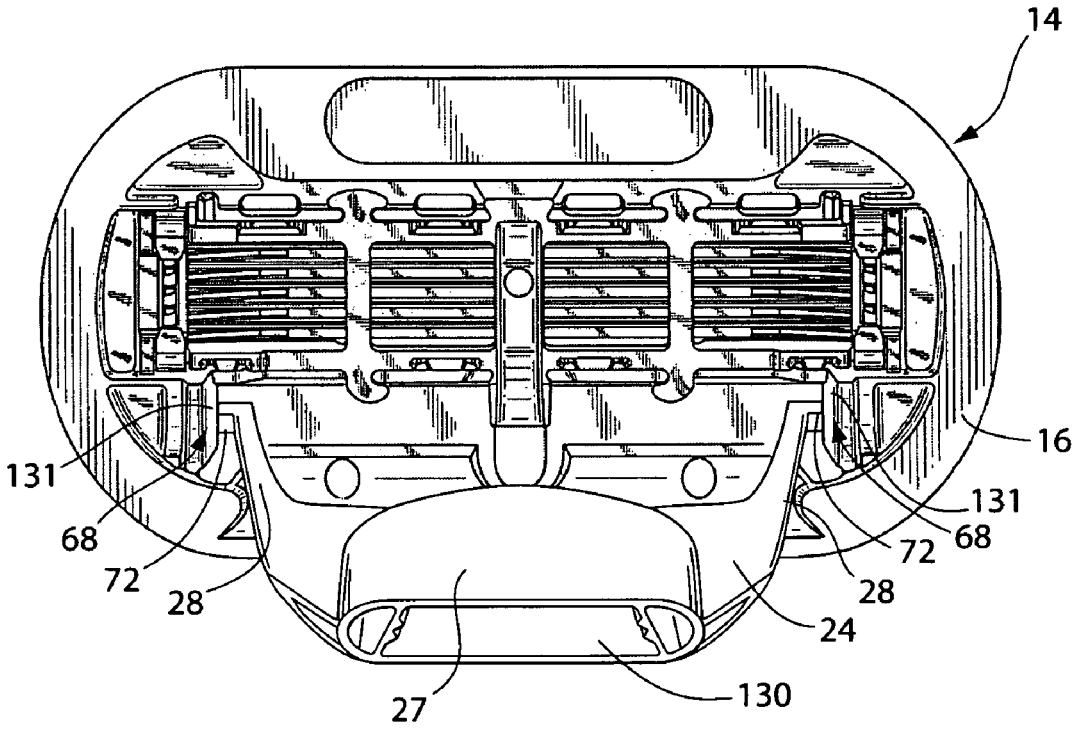
FIG. 14 is a bottom plan view of the cartridge of FIG. 1

FIG. 14 shows further details of replaceable cartridge 14 and its pivotal movement. Interconnect member 24 is shown assembled to pivotal frame 16 with pivotal support ends 72 retained within recess 68. Base structure 27 has a shaped recess 130 that has the same shape as extension 26 (FIG. 2) and mates with extension 26. Arms 28 of interconnect member 24 deflect as support ends 72 are inserted through the openings to recesses 131 and then snap back to an undeflected potion after ends 72 are within recesses 131 to retain ends 72 in place.

Figure 15:
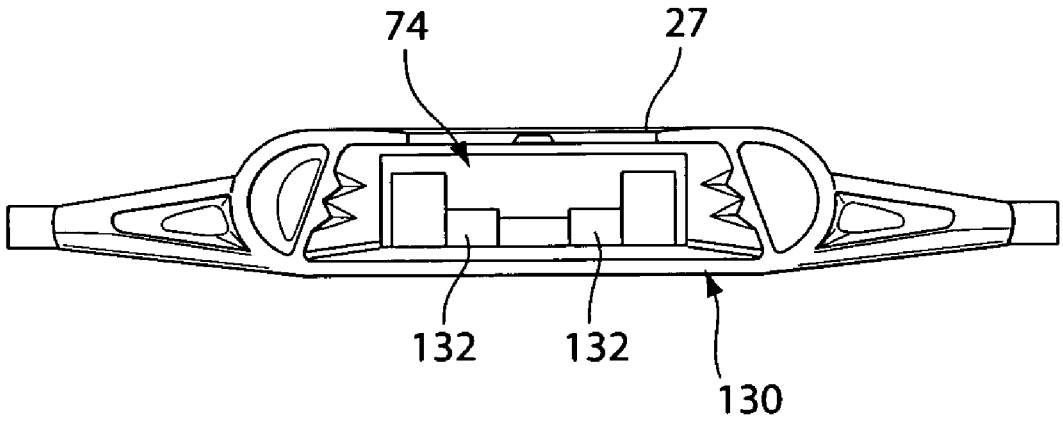
FIG. 15 is a rear view of the interconnect member of the cartridge of FIG. 1.

Referring to FIGS. 5, 8 and 15, projections 132 within recess 130 of base 27 mate with depressions 122 of extension 26. At the top of recess 130 is opening 74 which permits spring-biased plunger 44 to extend through and from base 27 and to interact with camming surface 32 on blade unit 18.

Figure 16:
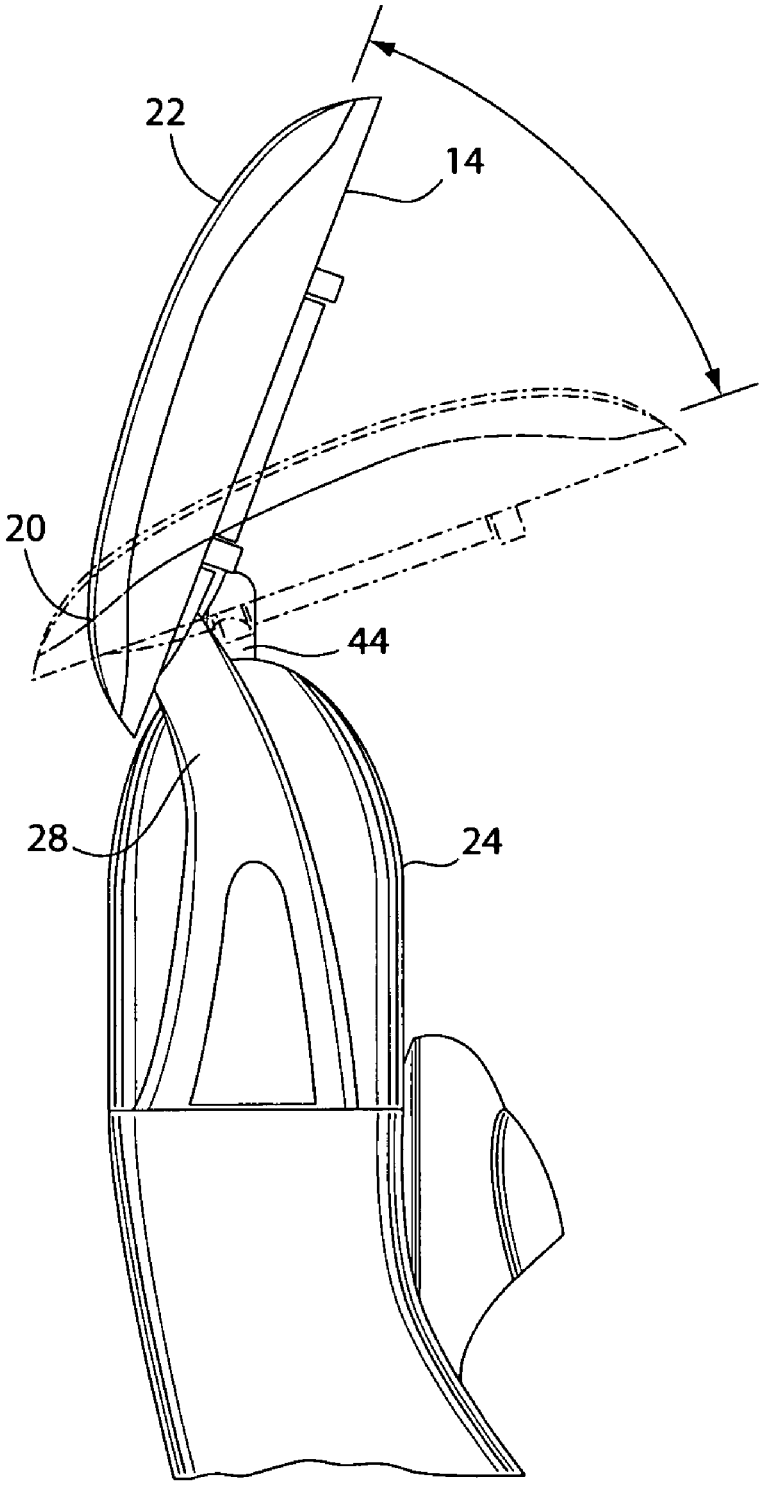
FIG. 16 is a side view, partially broken away, showing the range of pivotal movement of the cartridge of FIG. 1.

FIG. 16 shows the range of pivotal motion for cartridge 14. Cartridge 14 is shown with interconnect member 24 and arms 28 of interconnect member 24. During shaving cap 22 will initially contact the user's skin, and cartridge 14 will pivot clockwise and generally follow the contours of the user's face, being biased by plunger 44. The cap up initial orientation will cause the blade closer to cap 22 to initially be pushed against the skin more than the blades closer to guard. However, the pivot at the region of guard 20 and the light return force cause the cartridge to be "guard heavy" during shaving with a higher load on the guard than the cap.

The base structure could be held on to the pivotal frame with a releasable latch. The blades could be loaded from the bottom instead of the top. The cartridge support structure could be made as a unit separate from the handle and attached to it. The pivotal connection could be provided by pins in respective holes, shell bearding and other techniques.

In the embodiment shown in FIGS. 1 and 2, a shaving system is depicted in which when the blades become dull from use, the cartridge is discarded and replaced on the handle with a new cartridge. The present invention may also be practiced with a disposable razor such that when the blades become dull from use, the entire razor is discarded and replaced with a new razor.

Figure 17:
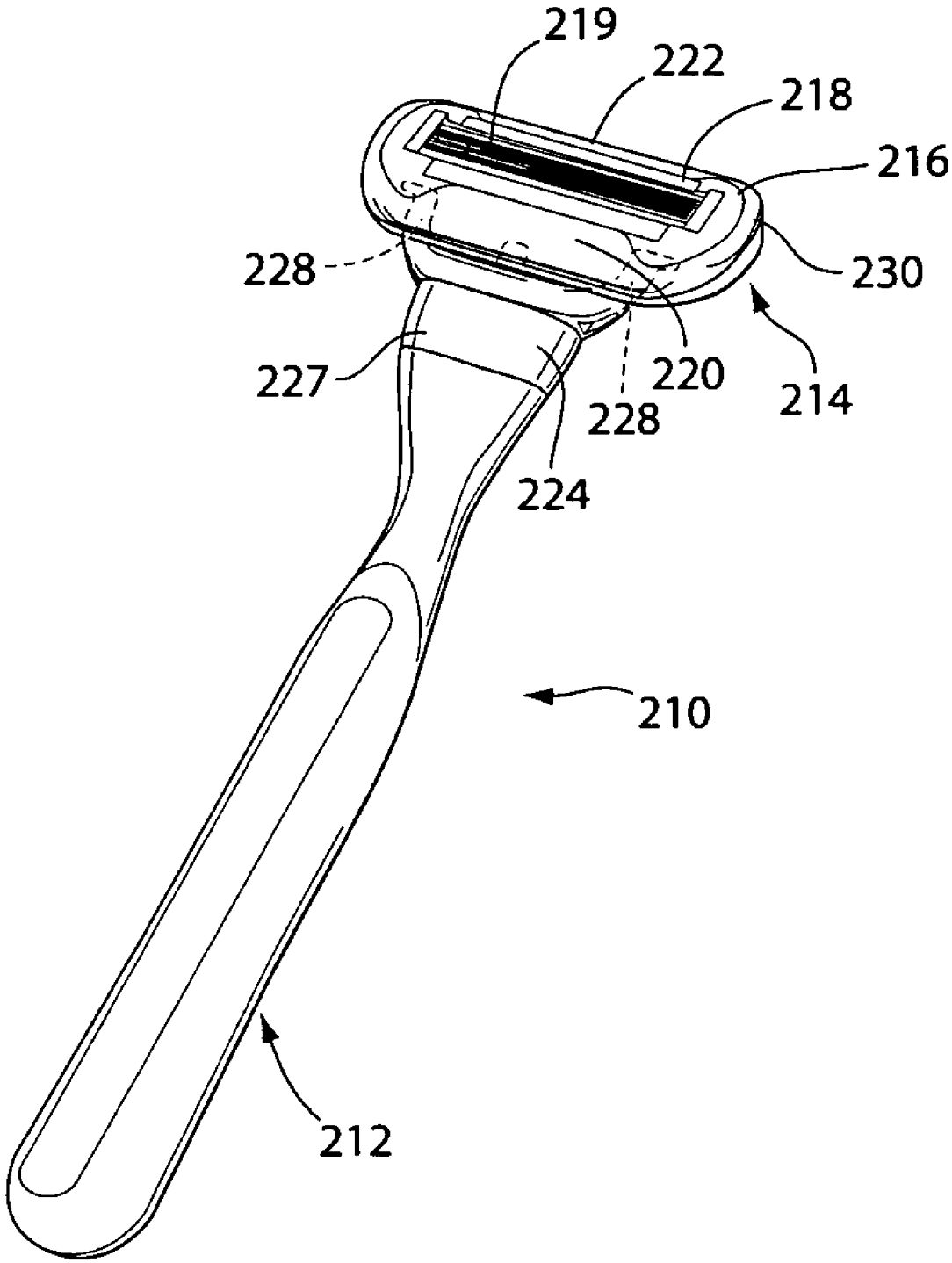
FIG. 17 is a front perspective view of another embodiment of a shaving razor of the present invention.
Figure 18:
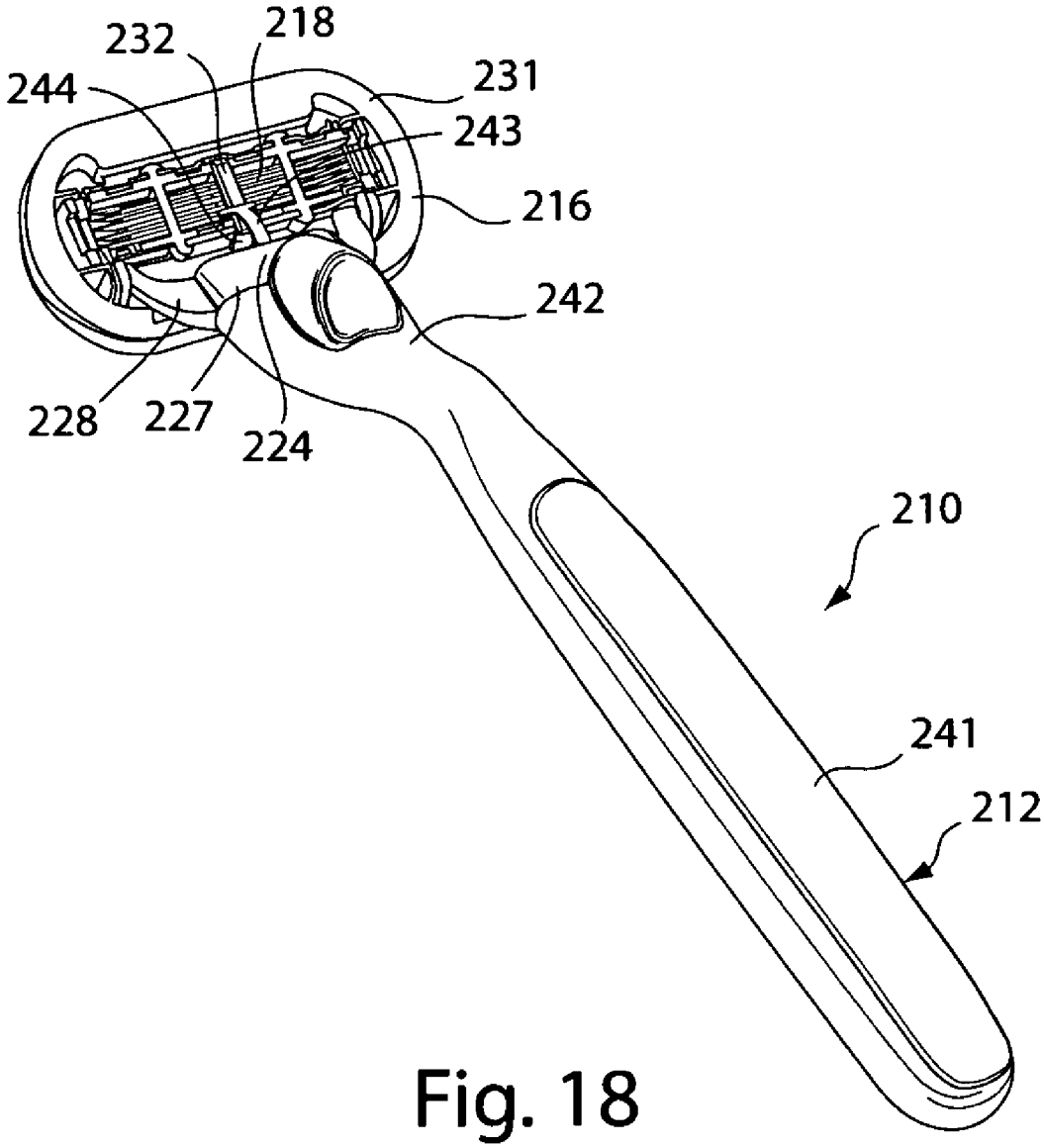
FIG. 18 is a rear perspective view of the shaving razor of FIG. 17.

Referring to FIGS. 17 and 18, disposable shaving razor 210 includes handle 212 and shaving cartridge 214. Cartridge 214 is secured to handle 212 such that it is not removable from handle 212. Cartridge 214 includes pivotal frame 216 and blade unit 218 moveably secured to pivotal frame 216. Cartridge 214 also includes interconnect member 224 on which pivotal frame 216 is pivotally mounted. Interconnect member 224 includes central base 227, which is fixedly attached to handle 212 and two arms 228 extending from central base 227 that pivotally support pivotal frame 216 at its two sides.

Pivotal frame 216 includes an upper surface 230 and a lower surface 231. Upper surface 230 of pivotal frame 216 is the skin contacting surface or shaving surface of pivotal frame 216. Upper surface 230 of pivotal frame 216 includes a guard 220 and a cap 222. Blade unit 218 includes one more blades 219. In the embodiment shown in FIGS. 17 and 18, blade unit 218 includes three blades 219. Blade unit 218 also includes camming surface 232.

Cartridge support structure 242 of handle 212 extends from the end of elongated gripping portion 241. Interconnect member 224 is secured to cartridge support structure 242 of handle 212. Biasing member 243 which in this embodiment is a cantilever spring 244 extends from interconnect member 224 to act on the camming surface 232 to bias the blade unit 218. The cantilever spring 244 extends from the central base 227 of the interconnect member 224.

Figure 19:
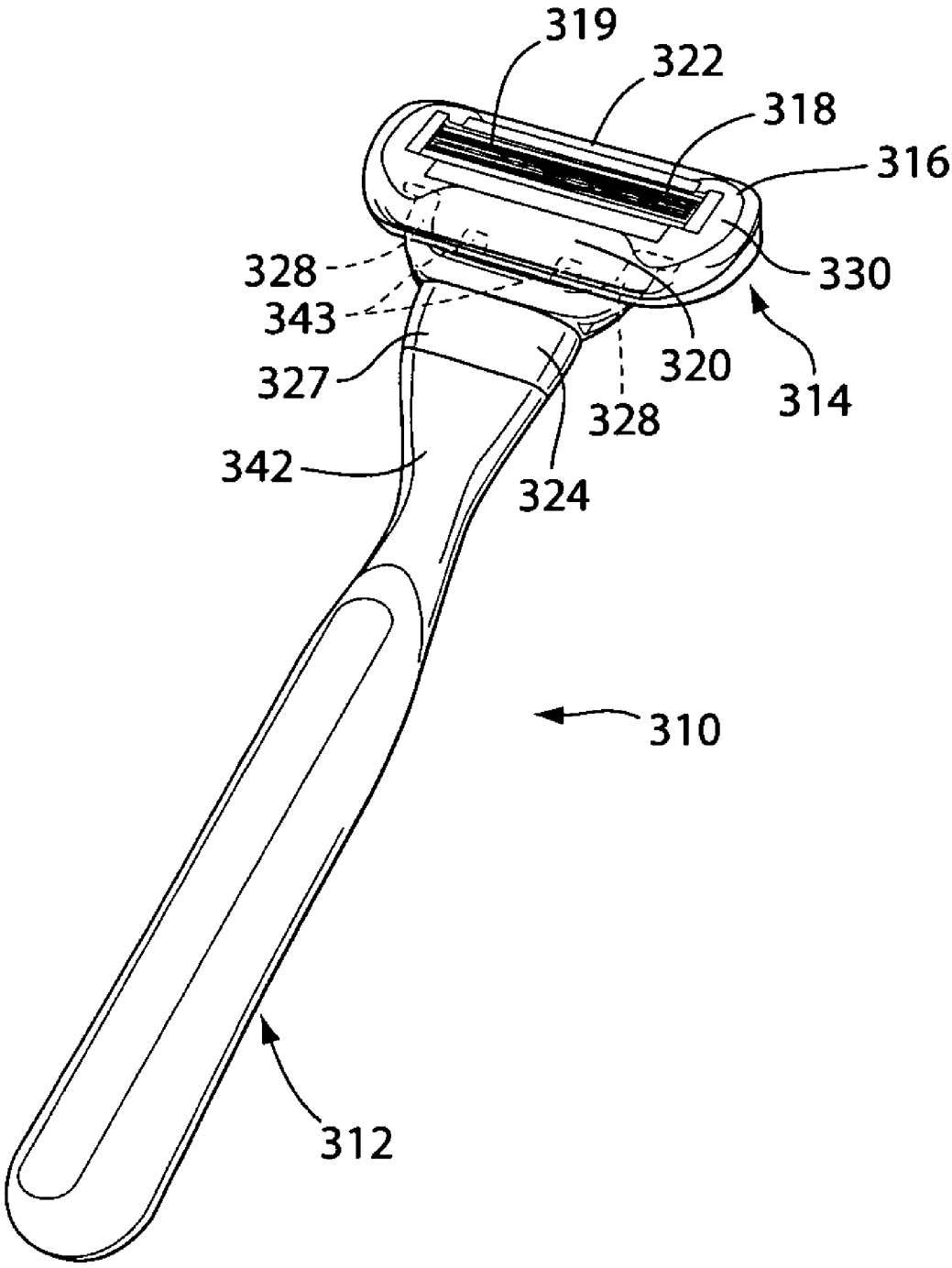
FIG. 19 is a front perspective view of another embodiment of a shaving razor of the present invention.
Figure 20:
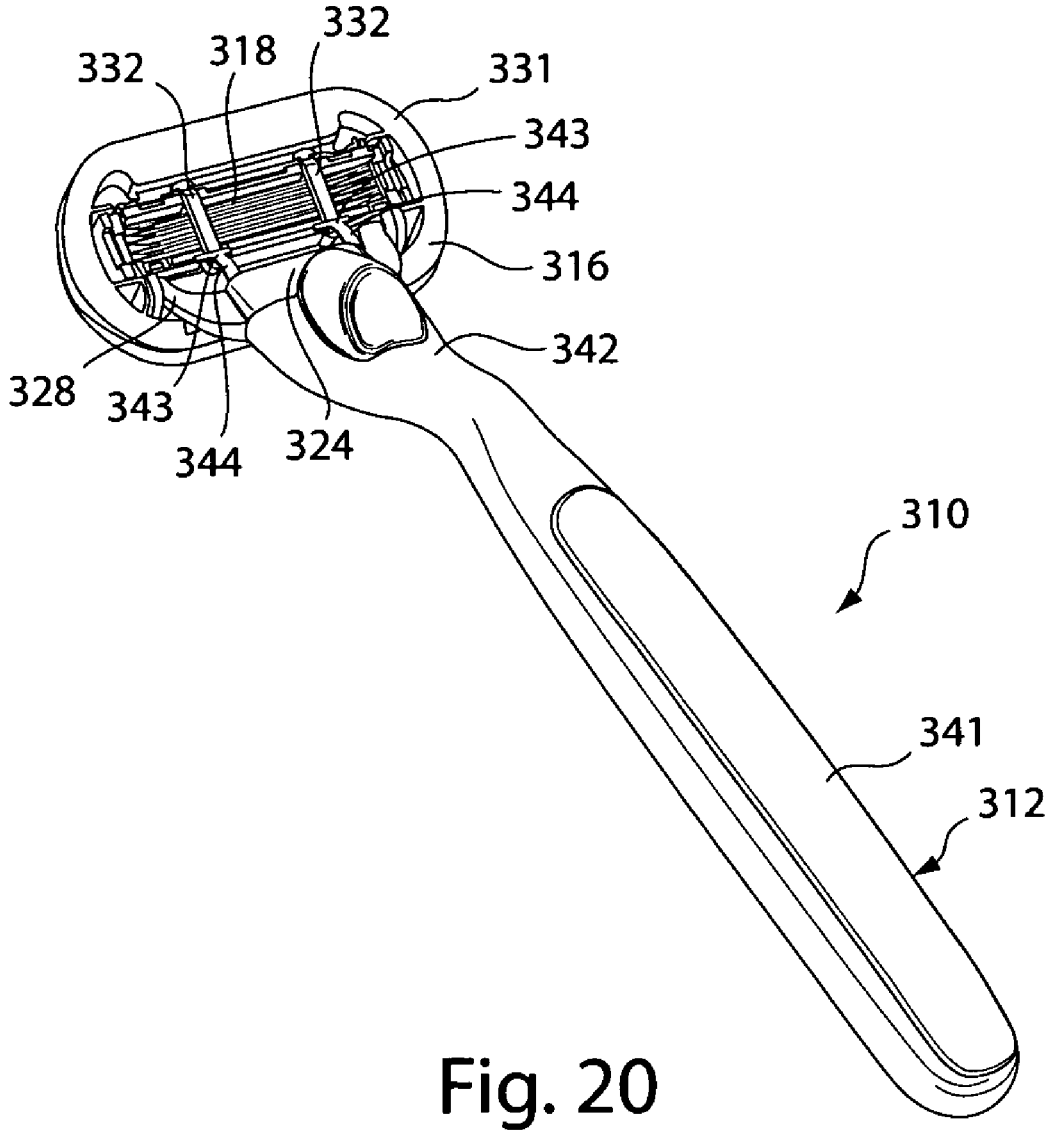
FIG. 20 is a rear perspective view of the shaving razor of FIG. 19.

Referring to FIGS. 19 and 20, disposable shaving razor 310 includes handle 312 and shaving cartridge 314. Cartridge 314 is secured to handle 312 such that it is not removable from handle 312. Cartridge 314 includes pivotal frame 316 and blade unit 318 moveably secured to pivotal frame 316. Cartridge 314 also includes interconnect member 324 on which pivotal frame 316 is pivotally mounted. Interconnect member 324 includes central base 327, which is fixedly attached to handle 312 and two arms 328 extending from central base 327 that pivotally support pivotal frame 316 at its two sides.

Pivotal frame 316 includes an upper surface 330 and a lower surface 331. Upper surface 330 of pivotal frame 316 is the skin contacting surface or shaving surface of pivotal frame 316. Upper surface 330 of pivotal frame 316 includes a guard 320 and a cap 322. Blade unit 318 includes one more blades 319. Blade unit 318 also includes camming surfaces 332.

Cartridge support structure 342 of handle 312 extends from the end of elongated gripping portion 341. Interconnect member 324 is secured to cartridge support structure 342 of handle 312. Biasing member 343 which in this embodiment include two cantilever springs 344 extend from interconnect member 324 to act on the camming surfaces 332 to bias the blade unit 318. The cantilever springs 344 extend from the central base 327 of the interconnect member 324.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising:

a replaceable shaving cartridge comprising a pivotal frame, a blade unit moveably secured to said pivotal frame between a first position and a second position and an interconnect member;

said blade unit comprising a camming surface and one or more blades;

said interconnect member having a pivotal support structure that pivotally supports said pivotal frame for pivoting about a pivot axis and a central base structure having a recess and a cam follower opening in communication with said recess and facing said camming surface;

a handle having a cartridge support structure shaped to mate with said recess and a biasing member that has a cam follower surface that extends through said cam follower opening of said interconnect member to act on said camming surface to bias said blade unit toward said second position.

2. The razor of claim 1 wherein said biasing member comprises a spring biased plunger.

3. The razor of claim 1 wherein said biasing member comprises a cantilever spring.

4. The razor of claim 1 wherein said razor comprises at least two biasing members.

5. The razor of claim 1 wherein said pivotal frame has an upper surface and a lower surface, said came follower biasing said blade unit toward said upper surface of said pivotal frame.

* * * * *

UNITED STATES PATENT AND TRADEMARK OFFICE

CERTIFICATE OF CORRECTION

PATENT NO. : 7,770,294 B2
APPLICATION NO. : 11/897313
DATED : August 10, 2010
INVENTOR(S) : Michael H. Bruno et al.

It is certified that error appears in the above-identified patent and that said Letters Patent is hereby corrected as shown below:

Column 1

Line 41, delete "comprises"

Column 1

Line 43, delete the second "THE"

Column 2

Line 15, delete "view a handle" and insert --view of a handle--

Column 8

Line 4, delete "came" and insert --cam--

Signed and Sealed this

Twenty-eighth Day of September, 2010

David J. Kappos

David J. Kappos
*Director of the United States Patent and Trademark Office*